US005305694A

United States Patent [19]

Wronkiewicz et al.

[11] Patent Number: 5,305,694

[45] Date of Patent: Apr. 26, 1994

[54] SIDEFRAME WITH INCREASED FATIGUE LIFE HAVING LONGER CROSS-SECTIONAL THICKNESS TRANSITION ZONE

[75] Inventors: Robert D. Wronkiewicz, Park Ridge, Ill.; Franklin S. McKeown, St. Louis, Mo.

[73] Assignee: AMSTED Industries Incorporated, Chicago, Ill.

[21] Appl. No.: 79,102

[22] Filed: Jun. 17, 1993

[51] Int. Cl.[5] ..... B61F 5/52

[52] U.S. Cl. ..... 105/206.1

[58] Field of Search ..... 105/206.1, 206.2

[56] References Cited

U.S. PATENT DOCUMENTS

| | | | |
|---|---|---|---|
| 2,235,799 | 3/1941 | Cottrell | 105/206.1 |
| 2,873,691 | 2/1959 | Guins | 105/198.4 |
| 3,000,330 | 9/1961 | Shafer | 105/206.1 |
| 3,687,086 | 8/1972 | Barber | 105/206.1 X |
| 3,837,293 | 9/1974 | Neumann et al. | 105/198.4 |
| 4,192,240 | 3/1980 | Korpics | 105/225 |
| 4,248,318 | 2/1981 | O'Neil | 177/137 |
| 4,254,712 | 3/1981 | O'Neil | 105/198.5 |
| 4,363,278 | 12/1982 | Mulcahy | 105/218.1 |
| 4,424,750 | 1/1984 | Tilly et al. | 105/206.1 |
| 4,870,914 | 10/1989 | Radwill | 105/206.2 |
| 5,226,369 | 7/1993 | Weber | 105/206.1 |

OTHER PUBLICATIONS

"Engineering Materials and Their Applications: 3rd Edition"; Flim et al; Houghton-Mifflen Co.; Boston, 1986, pp. 598-600 and 607.

*Primary Examiner*—Robert J. Oberleitner
*Assistant Examiner*—S. Joseph Morano
*Attorney, Agent, or Firm*—Edward J. Brosius; F. S. Gregorczyk; Thomas J. Schab

[57] ABSTRACT

The present invention involves structurally changing an American Association of Railroads (AAR) standard 100 ton sideframe so that it is statically and dynamically capable of handling a 110 ton payload; this is accomplished by reducing two weak points on the sideframe. The first weak point is located in the sideframe upper compression member, near the vertical support column, and the second weak point is the upper portion of the area comprising the lower diagonal tension member core support hole. Stresses in the this area are reduced by gradually extending the zone where cross-sectional wall thicknesses normally experience an abrupt change. The gradual decrease in cross-sectional areas increases the static strength of the sideframe by increasing the elastic or ultimate loading limits. In the second area metallic mass is added, thereby increasing the section modulus of the sideframe near the core support hole. Increasing the section modulus increases the number of flexure stresses which the improved AAR standard 100 ton sideframe can withstand, allowing this sideframe to meet AAR dynamic testing standards set for a 100 ton sideframe, even though it's loaded with 110 tons of payload.

3 Claims, 2 Drawing Sheets

SIDEFRAME WITH INCREASED FATIGUE LIFE HAVING LONGER CROSS-SECTIONAL THICKNESS TRANSITION ZONE

FIELD OF THE INVENTION

This invention relates to an improved railcar truck and more particularly, to a statically and dynamically strengthened sideframe for a three piece freight car truck.

BACKGROUND OF THE INVENTION

Three piece trucks, which are comprised of two parallel sideframes and a bolster extending therebetween, are well known and used within the majority of freight railcars in service today. Each sideframe is comprised of a upper compression member, a lower tension member, and a pair of vertically extending support columns which join the upper and lower members together. The upper compression member has a pair of ends, each of which includes a pedestal jaw depending therefrom for receiving the transversely extending wheel axles. The lower tension member extends in a generally parallel direction to the upper member and is comprised of a longitudinal central portion which also has a pair of ends. Each end is comprised of an upwardly extending diagonal arm which extends to and attaches with the upper compression member and pedestal jaw. The vertical support columns in each of the sideframes are longitudinally spaced from each other and attach to the lower tension member where the lower member ends upwardly extend, thereby forming the bolsters opening in their respective sideframe. A transversely disposed bolster is received within each of the bolster openings and the ends of the bolster are supported by spring groups which are supported by the lower tension member of each respective sideframe.

Three piece trucks are well known for their strength, durability, and capability to support great vertical truck loads. However, a problem facing the railroad industry is that the American Association of Railroads (AAR) has set standards and established recognized practices for only discrete payload weight limits. By AAR standard M-203-83, for railcar sideframe specifications, a railroad owner/operator must choose to operate his fleet with either the AAR approved sideframe having the 6.5 inch by 12 inch journal bearing, or the 7 inch by 12 inch bearing. The former provides 100 tons of capacity per railcar and a total rail load weight of 263,000 pounds, while the latter provides 125 tons of capacity per car and a total rail load of 315,000 pounds; total rail load weight includes the payload and the weight of the train components. This also means that all railcars operating at either weight limit must meet the AAR Section 4 and 6 static and dynamic loading requirements at these two service limits. With modern day railroad operations, it is desirable to maximize the payload weight carried per mile in order to efficiently operate and contain costs. However, railroad owner/operators have found that when operating with the very large, 125 ton service loads, the rails and wheels are placed under extreme service conditions, causing them to wear in a rather short period of time. Shorter useful operating lives of the wheels and rail components is not cost feasible considering the miles of track and the number of railcars in service.

Nevertheless, owner/operators find it desirable to operate their fleets above the 100 ton standard and with systems which will be safe and cost effective. However, the AAR has only approved and standardized the 100 ton and 125 ton trucks. In order to currently operate somewhere between the 100 ton and 125 ton standards, an owner/operator is faced with a common dilemma; settle on using the smaller 100 ton trucks, or use 125 ton trucks and incur extra weight and costs for using an oversized truck.

Using the 125 ton truck and associated equipment for only 110 tons of payload capacity has not been well received in the industry since the 125 ton truck and associated equipment is very much larger and heavier and also more expensive to purchase and maintain, compared to the 100 ton truck. The added weight and expense of using a 125 ton truck in this application incrementally adds more cost per mile than can be justified by the incremental increase in payload weight gained per mile.

It is therefore the desire of the railroad owner/operators to operate with service loads of 110 tons per truck (286,000 pounds of total rail load) on trucks which are the same size and weight as the 100 ton trucks and are specifically designed to carry the 110 tons of payload.

However, an operating weakness of all trucks, and especially 100 ton trucks designed for adaptation to 110 ton service, is their tendency to be prone to fatigue cracking brought about by load cycling and to a lesser extent, static loading deflection. It should be understood that the AAR standards for dynamic loading allow the appearance of crack formations at a certain minimum number of flexure cycles as long as the sideframe can still safely operate out to the required maximum number of flexure cycles. Therefore, it should not be implyed that crack formations automatically result in catastrophic sideframe failure.

More specifically, it has been found that when adapting the standard 100 ton truck for pro-rated 110 ton payloads, and then performing the equivalent AAR static and dynamic loading performance standards on the sideframe as one would for a 100 ton loaded truck, the lower tension member of the truck sideframe is substantially susceptible to fatigue cracking, while the upper compression member is vulnerable to problems associated with increased static loading. The static loading problems are usually the result of increased vertical deflection, or reaching and/or exceeding elastic and ultimate loading limits so that failures can occur. Not particular to only the 100 ton sideframe, the area on the upper compression member, generally from the support columns to the pedestal jaws, has been cast with a reduced dimensional thickness. This has typically been done this way since the static moments closer to the jaw area are lower than the other areas of the sideframe. This means that when the 100 ton trucks are statically loaded with 110 ton payloads, the area which generally reduces in thickness, herein referred to as the transitional zone, is succeptable to stress accumulations as a result of the rather abrupt dimensional change in cross-sectional thickness, thereby weakening the sideframe. It has also been discovered that part of the stress concentration problem results after casting and is caused by the thinner cross-sectional area cooling at a faster rate than the thicker cross-sectional area. Likewise, the uneven cooling rates cause uneven shrinkage rates, and it is the uneven shrinkage rates which create the inherent internal stresses which are the result of uneven metallurgical grain structure formations. The stress accumulation is especially pronounced if there are any casting flaws present, such as internal shrinkage. In any event, the abrupt reduction in cross-sectional area will tend to concentrate the stresses and statically weaken the sideframe.

The second area on the 100 ton sideframe which experiences load-influenced problems during 110 tons of service load, is found on the lower sideframe tension member. More specifically, flexure fatigue cracking will occur on each of the upwardly extending diagonal arms, generally on the upper portion of each of the core support holes located in the arms. Since it is well known by engineering principals that stresses tend to concentrate around holes, a bending moment diagram and analysis was performed for the sideframe. It was discovered that when the dynamic flexure moments caused by 110 tons of payload were divided by the corresponding section modulus at any particular point of loading, the ratios showed that the core support hole area was substantially the weakest area on the sideframe, even though the magnitude of the flexure moments was almost the lowest.

SUMMARY OF THE INVENTION

Accordingly, it is the primary object of the present invention to reduce the stress concentrations at each of these critical areas of the 100 ton sideframes in order to statically and dynamically strengthen the 100 ton sideframes so that they can be used with 110 tons of payload while still meeting the AAR static and dynamic loading requirements for 100 tons trucks.

It is another object of the present invention to increase the elastic limit of the 100 ton sideframe upper compression member in order to statically strengthen the upper member and the sideframe as a whole.

It is yet another object of the present invention to increase the section modulus of the 100 ton sideframe lower tension member in order to dynamically strengthen the lower member and the sideframe as a whole, thereby providing additional fatigue life to the sideframe.

Briefly stated, the primary object of the present invention involves structurally changing the upper compression member by gradually reducing the transition zone thickness over an extended distance and then adding metallic mass to this reduced area in order to provide even cooling and shrinkage rates within the transitional area after it has been cast, and it also includes adding increased mass around the core support hole areas by reducing the casting length of the core support holes in each of the lower tension member diagonal arms. The added mass will increase the number of flexure-stressing cycles which a 100 ton sideframe can experience when using a 110 tons of payload.

DESCRIPTION OF THE PREFERRED EMBODIMENT

Figure 1:
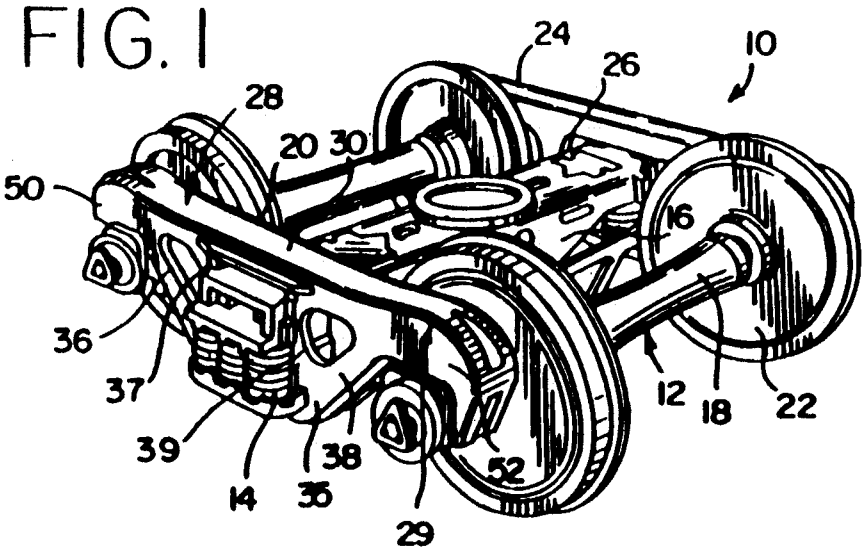
FIG. 1 is a perspective view of a railway truck of the present invention.

Referring now to the drawings, in particular to FIG. 1, there is shown a railway truck 10 incorporating the present invention. Truck 10 comprises a pair of lengthwise spaced wheel sets 12, each including an axle 18 having laterally spaced wheels 22 affixed thereon in the standard matter. A pair of transversely spaced sideframes 20,24 are mounted on the wheel sets 12 with each sideframe 20,24 including a bolster opening 26, in which it is supported by spring means 14, a bolster 16. The bolster 16 is of substantially standard construction and generally carries the weight of the freight car. Sideframe members 20,24 are identical and only one of them will be described in greater detail, although it should be understood that the present invention applies to both sideframes.

Figure 2:
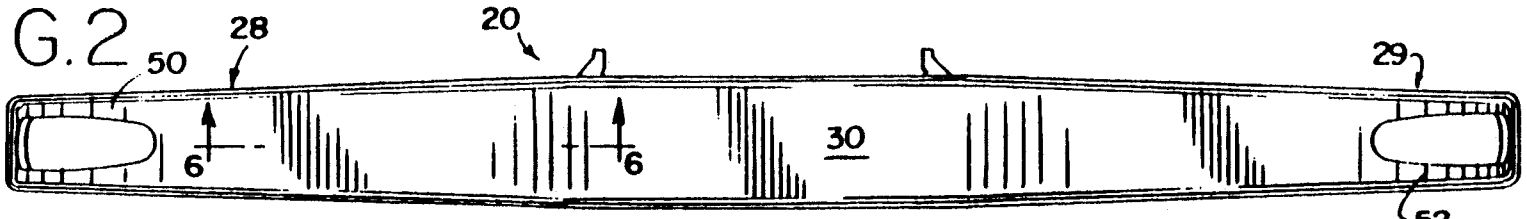
FIG. 2 is a plan view of a sideframe of the present invention generally showing the upper compression member.
Figure 3:
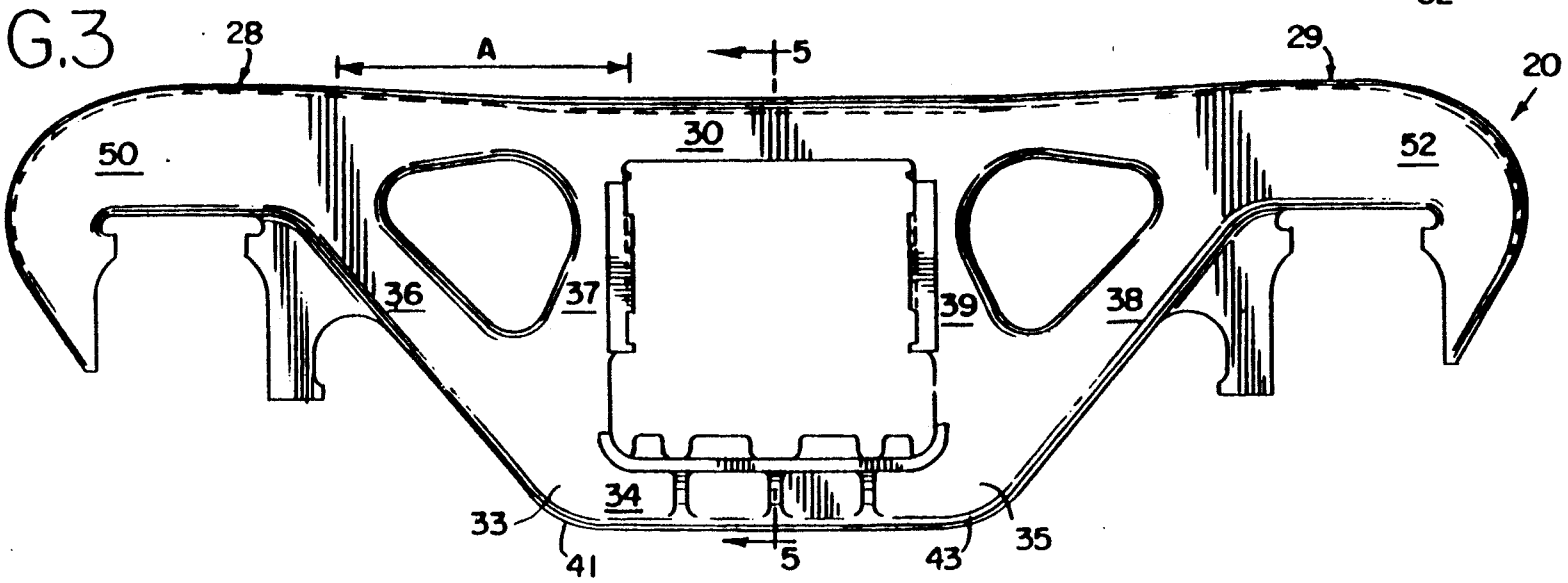
FIG. 3 is a side view of the sideframe of the present invention showing the transition zone area in the upper compression member where the cross-sectional thickness changes.

As illustrated in FIGS. 2 and 3, sideframe 20 comprises a upper compression member 30 extending lengthwise of truck 10, a lower tension member 34 generally parallel to upper member 30, and the upperly extending diagonal arms 36,38, connecting the upper and lower members together. Vertical column members 37,39 also connect the upper and lower members together, while forming the structural framework necessary for defining bolster opening 26. Each end 28,29 of upper member 30 also has a jaw portion 50, 52, downwardly depending therefrom. Likewise, upperly extending diagonal arms 36,38 depend from the first end 33 and second end 35 of lower member 34. The central portion of lower member 34 is interconnected to each arm 36,38, such that the point of connection forms a first and second bend point 41,43, which also includes the interconnection of each of the base portions of each vertical column members 37,39.

Figure 5:
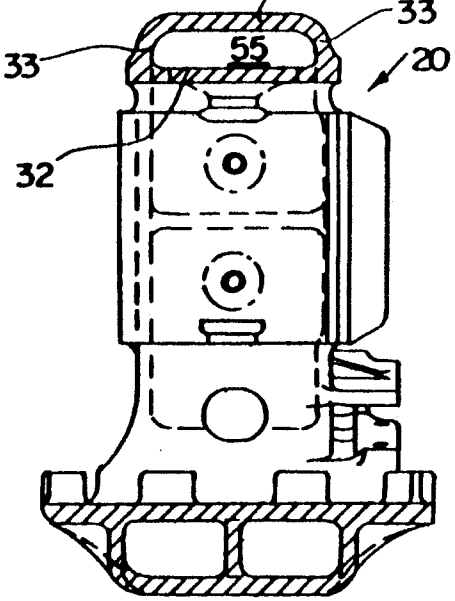
FIG. 5 is a cross-sectional view of the sideframe of the present invention taken along line 5—5 of FIG. 3 to emphasize the cross-sectional shape of the top compression member.
Figure 6:
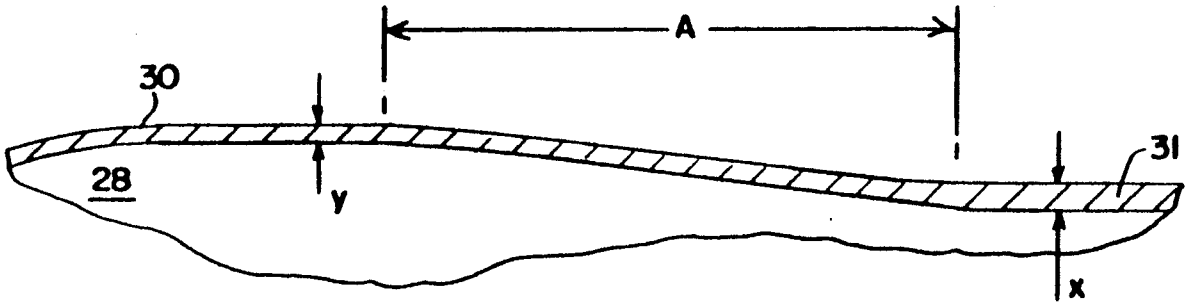
FIG. 6 is a cross-sectional view of the sideframe of the present invention taken along line 6—6 of FIG. 2, emphasizing the details of the transitional zone.

As seen from FIGS. 5 and 6, upper member 30 is actually comprised of a top wall 31, a bottom wall 32, and arcuate side walls 33. Each of the walls have specific cross-sectional wall thicknesses and the walls cooperatively define a core 55 which extends the longitudinal length or extent of sideframe 20. However, core 55 is not of a constant cross sectional area along the entire sideframe 20 and this is best illustrated from FIG. 6, where it is seen that the wall thickness of top wall 31 actually changes in cross-sectional thickness starting around the area just above each of the vertical support columns 37,39, and extending longitudinally towards pedestal jaws 50,52, with the dimensional change gradually occurring along the entire area designated as transitional zone "A". It is seen in this particular embodiment that the first cross-sectional wall thickness of the metal on the inboard side of transitional zone A, designated as dimension "x", is about 0.75 inches (1.905 cm). The second cross-sectional thickness on the outboard side of zone A, designated as dimension "y", decreases to about 0.50 inches (1.27 cm). Once the cross-sectional wall thickness is finally reduced to dimension "y", from the point outboard of zone A, the thickness remains constant up to pedestal jaws 50,52. The graduation zone A, is at least six inches long, and as seen from FIG. 3, the top surface is not completely planar along the entire longitudinal length of sideframe 20. The bottom wall 32 of upper compression member 30 remains a constant thickness along the length of top compression member 30.

As best explained by referral to FIG. 6, prior art sideframes typically cast top wall 31 with the same dimensional wall thicknesses as mentioned above, except that the transition in wall thicknesses occurred along a transitional zone A length of only two inches long (5.08 cm). With such a dramatic reduction in cross-sectional wall thicknesses over such a short distance, it was discovered that when the 100 ton sideframe was loaded with 110 ton payloads, the principal cause of failure in the upper compression member 30 was due to shrinkage-induced casting stresses concentrating in transitional zone A. These concentrated stresses were found to reduce the static loading capabilities of the sideframe when loaded with payloads over the 100 ton design limit. As best illustrated from FIG. 6, the molds and cores used in casting upper member 30 were modified so that metallic mass was added in transition zone A for the purpose of creating a more uniform cooling rates between the two cross-sectional wall thicknesses. It was also discovered that the transitional area had to be at least six inches (15.24 cm) long for creating a gradual decrease in wall thicknesses or else the internal stresses from the uneven cooling and shrinkage rates would otherwise still accumulate in zone A, such that the sideframe could not statically withstand the forces of the 110 ton payload. Ideally, it was discovered that the transition zone A should be extended as long as dimensionally practical, and in this particular sideframe, that maximum distance was found to be about 12 inches (30.48 cm) long, although it could be as long as 18 inches (45.72 cm).

Figure 4:
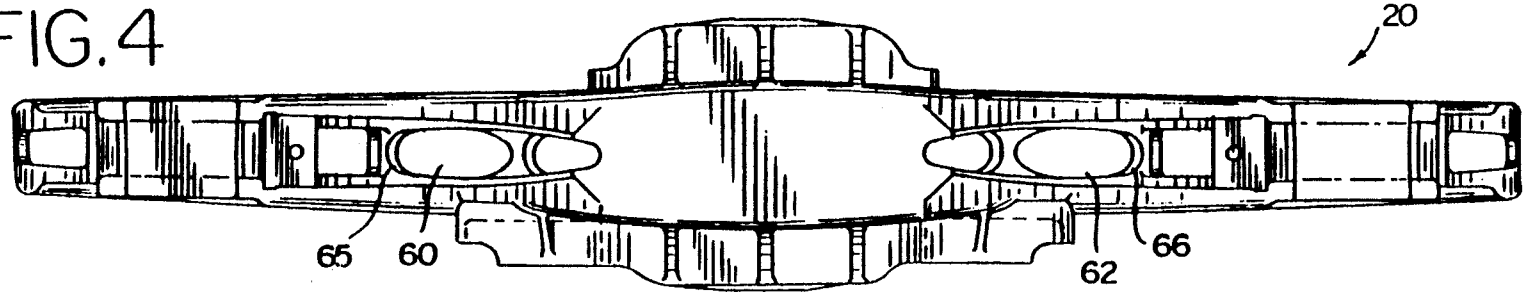
FIG. 4 is a bottom view of the sideframe of the present invention showing the location of the core support holes.

It was also discovered that when the 100 ton sideframe 20 was loaded with 110 tons and then dynamically tested to AAR standards, fatigue stress cracks occurred around the core support holes or openings 60,62 on lower member 34. As mentioned, it is known that holes act as stress concentration points, however, any anomaly in the cast metal surrounding holes 60,62, such as casting flaws due to pitting, will accumulatively react to decrease the fatigue life of the sideframe 20. Specifically, it was discovered that the highest concentration of stresses on each of the upwardly extending members 36,38 occurred near the top portion 65,66 of each of the core support holes 60,62. After studying this problem, it was found that when the bending or flexure moments experienced in top portions 65,66 were divided by the section modulus corresponding to these areas, the resultant ratios were larger than the comparative ratios in areas where the moments were actually the greatest. It is known that resistance to fatigue failure is a function of the bending or flexure moments divided by the section modulus, wherein the section modulus is a function of the moment of inertia for a specific structure. Therefore, preventing fatigue failure in areas 65,66 could be retarded by increasing the section modulus around these areas. As illustrated from FIG. 4, the upper edge 65 has been eliminated and filled with metal so that the section modulus in each of these areas could be increased, thereby increasing the resistance to fatigue crack formations. It has been ideally found that the filling of at least the top 2 inches (5.08 cm) of hole 60,62 will greatly retard crack initiation, otherwise top portions 65,66 are not structurally strong enough to meet the dynamic loading standards concerning fatigue crack formations.

The foregoing details have been provided to describe the best mode of the invention and further variations and modifications may be made without departing from the spirit and scope of the invention which is defined in the following claims.

What is claimed is:

1. An improved AAR standard 100 ton truck sideframe having a longitudinal axis, said improved sideframe comprising:

a longitudinally extending upper compression member having a front end, a back end, and a midpoint therebetween, said upper compression member front end having a downwardly projecting front pedestal jaw depending therefrom and said upper compression member back end having a downwardly projecting back pedestal jaw depending therefrom;

a longitudinally extending lower tension member generally parallel to said upper compression member having a central portion with a first end and a second end, said first end interconnected to an upwardly extending first diagonal arm and defining a first bend point, said second end interconnected to an upwardly extending second diagonal arm and defining a second bend point, each of said diagonal arms extending upwards to and connecting with a respective upper compression member end at a respective said pedestal jaw; and a pair of vertically extending columns disposed in proximity to said sideframe midpoint, each of said columns being longitudinally spaced fore and aft of said sideframe midpoint and connecting said upper and lower members together;

said upper compression member having a top wall with a cross-sectional wall thickness, a bottom wall with a cross-sectional wall thickness, and a pair of arcuate side walls having respective cross-sectional wall thicknesses, said arcuate side walls connecting said upper and bottom walls, said upper, bottom, and arcuate side walls cooperating to define a core which continuously extends between said front and back pedestal jaws, said top wall of said upper compression member having a first cross-sectional wall thickness of about 0.75 inches (1.905 cm) approximate to and above each of said vertical columns and a second and thinner cross-sectional wall thickness of about 0.50 inches (1.27 cm) longitudinally disposed between six inches (15.24 cm) and twelve inches (30.48 cm) from said respective first cross-sectional wall thickness, said top wall of said upper compression member gradually decreasing in cross-sectional wall thickness from said first cross-sectional wall thickness to said second cross-sectional all thickness, wherein said gradually decreasing cross-sectional wall thickness increases the static strength of said sideframe such that said improved 100 ton AAR standard sideframe can be loaded with 110 tons of payload without reaching the AAR ultimate loading limits set for a standard AAR 100 ton sideframe, and wherein said lower tension member includes two core support holes having additional metallic mass, one of said two holes being located on said first upwardly extending diagonal arm and the other of said two holes being located on said second upwardly extending diagonal arm, each of said core support holes substantially equal in size and second modulus, with each of said core support holes experiencing substantially equivalent flexure stresses in the area around said holes, said flexure stresses around said holes being lower in magnitude than at other points of loading along said sideframe, each of said core support holes sized such that said magnitude of flexure stresses around said holes, when divided by said section modulus, results in a ratio which is smaller than a ratio derived from a core support hole without the additional mass, said core support holes allowing an AAR standard 100 sideframe to meet AAR dynamic testing standards set for a 100 ton sideframe although said sideframe is loaded and flexured with 110 tons of payload.

2. The truck sideframe of claim 1 wherein said bottom wall of said upper compression member has a generally constant cross-sectional wall thickness along the longitudinal extent of said sideframe.

3. The truck sideframe of claim 2 wherein said core at said first top wall cross-sectional thickness has a first cross-sectional area, and said core at said second top wall cross-sectional thickness has a second cross-sectional area, said core cross-sectional area gradually increasing from said first core cross-sectional area to said second cross-sectional.

* * * * *

UNITED STATES PATENT AND TRADEMARK OFFICE

CERTIFICATE OF CORRECTION

PATENT NO. : 5,305,694

DATED : April 26, 1994

INVENTOR(S) : Robert D. Wronkiewicz and Franklin S. McKeown

It is certified that error appears in the above-identified patent and that said Letters Patent is hereby corrected as shown below:

In Column 6, Line 56, Claim 1, change "all" to --wall--;

In Column 7, Line 2, Claim 1, change "second" to --section--.

Signed and Sealed this

Second Day of August, 1994

*Attest:*

Bruce Lehman

BRUCE LEHMAN

*Attesting Officer*

*Commissioner of Patents and Trademarks*